United States Patent [19]

Specht

[11] 4,413,960

[45] Nov. 8, 1983

[54] POSITIONABLE CONTROL DEVICE FOR A VARIABLE DELIVERY PUMP

[76] Inventor: Victor J. Specht, 197 S. Saginaw St., Pontiac, Mich. 48058

[21] Appl. No.: 250,341

[22] Filed: Apr. 2, 1981

[51] Int. Cl.[3] ..... F04C 2/10; F04C 15/04

[52] U.S. Cl. ..... 418/19; 418/26; 418/27; 418/171

[58] Field of Search ..... 418/16, 19, 24–27, 418/166, 171

[56] References Cited

U.S. PATENT DOCUMENTS

| | | | |
|---|---|---|---|
| 2,266,191 | 12/1941 | Granberg . | |
| 2,588,032 | 3/1952 | O'Brien | 418/27 |
| 2,649,739 | 8/1953 | Hufferd et al. . | |
| 2,678,607 | 5/1954 | Hufferd et al. . | |
| 2,685,842 | 8/1954 | Hufferd . | |
| 2,688,927 | 9/1954 | Nuebling . | |
| 2,898,862 | 8/1959 | Brundage | 418/171 |
| 3,007,418 | 11/1961 | Brundage | 418/19 |
| 3,026,810 | 3/1962 | Kubiak et al. . | |
| 3,038,413 | 6/1962 | Emeny et al. . | |
| 3,106,897 | 10/1963 | Johnson . | |
| 3,198,127 | 8/1965 | Brundage . | |
| 3,473,477 | 10/1969 | Thompson et al. . | |
| 3,728,048 | 4/1973 | Ratliff, Jr. | 418/26 |
| 4,097,204 | 6/1978 | Palmer | 418/19 |

FOREIGN PATENT DOCUMENTS

| | | | |
|---|---|---|---|
| 2135861 | 2/1973 | Fed. Rep. of Germany | 418/166 |
| 1426223 | 2/1976 | United Kingdom | 418/19 |

*Primary Examiner*—John J. Vrablik

*Attorney, Agent, or Firm*—Cullen, Sloman, Cantor, Grauer, Scott & Rutherford

[57] ABSTRACT

A control device for a positionable pump has a body with inner and outer diameters eccentric to each other mounted in the pump housing bore and is actuated by hydraulic pressure in one angular direction. An opposing spring force acts in the opposite direction for controlling the angular position of the body. A controlled member is nested in the inside diameter of the body and a power rotated control member is nested within and drivingly engages the controlled member and is eccentric thereto, being a pair of pumping elements. The pump elements being gerotor or vane type elements utilized to pump fluids and which depend upon the eccentric position of their relative components for a fixed delivery of fluids. The body is controlled in infinitely angular positions relative to the pump housing to regulate the eccentric position of such pumping elements and thereby controlling the volume output of said pump elements relative to the demand of the external system increasing and diminishing needs.

16 Claims, 14 Drawing Figures

FIG. 1
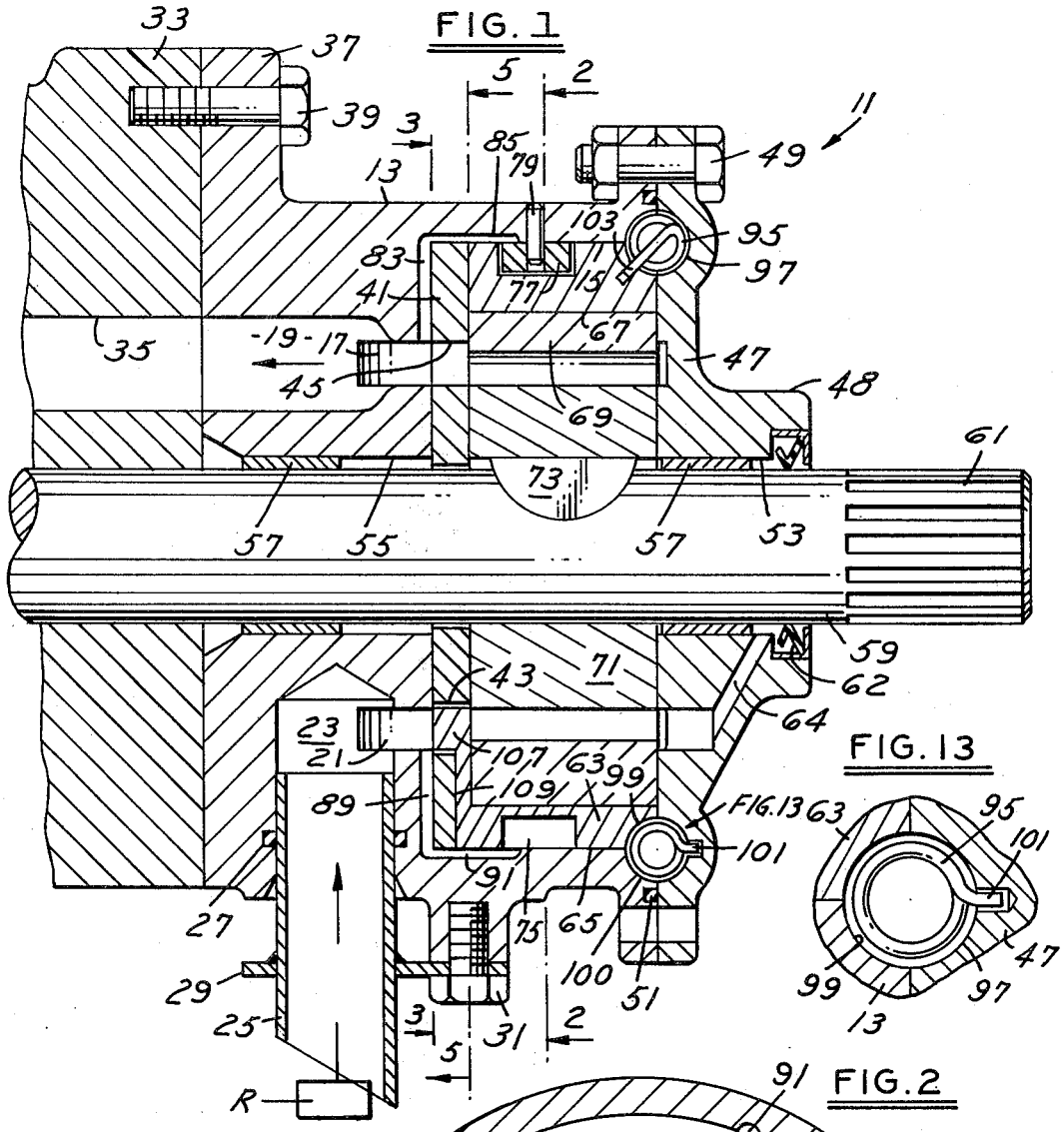
FIG. 13
FIG. 2
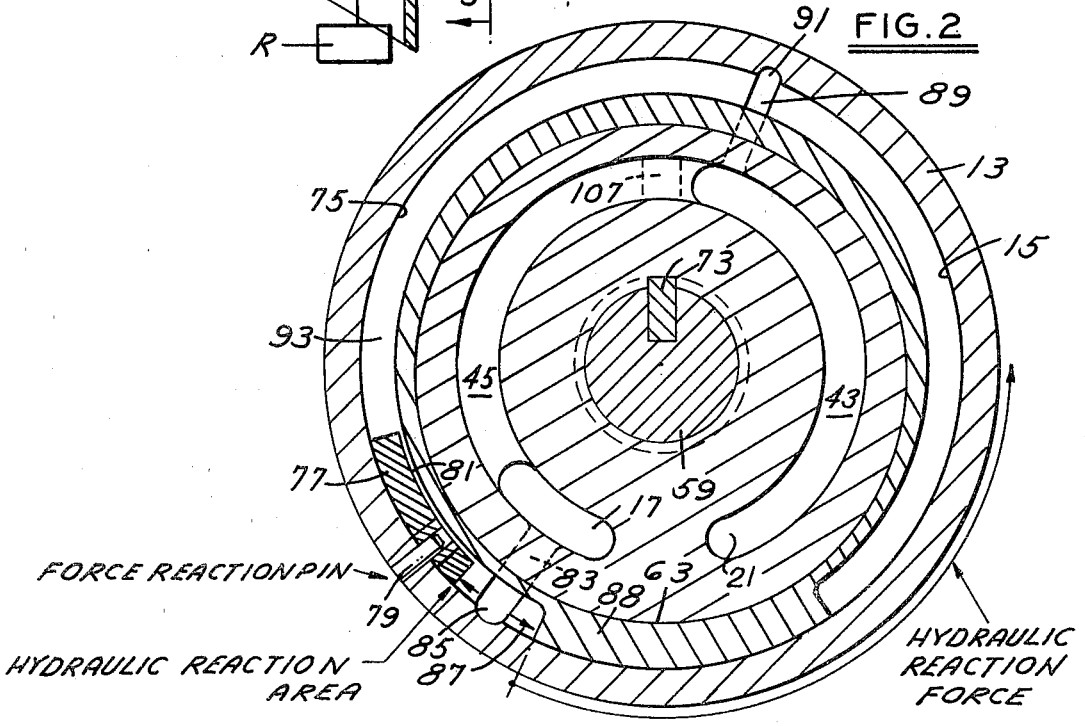

FIG. 6
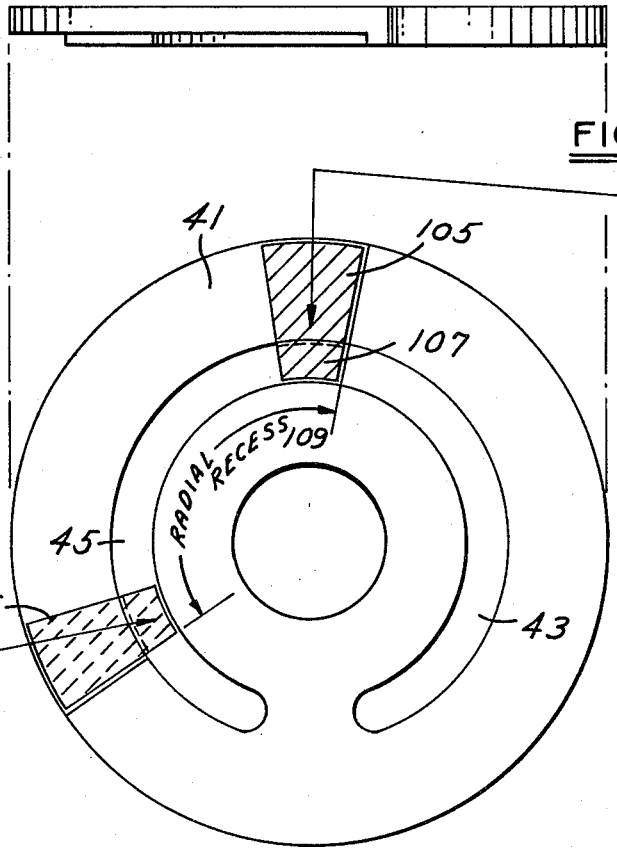
FIG. 5
FIG. 12
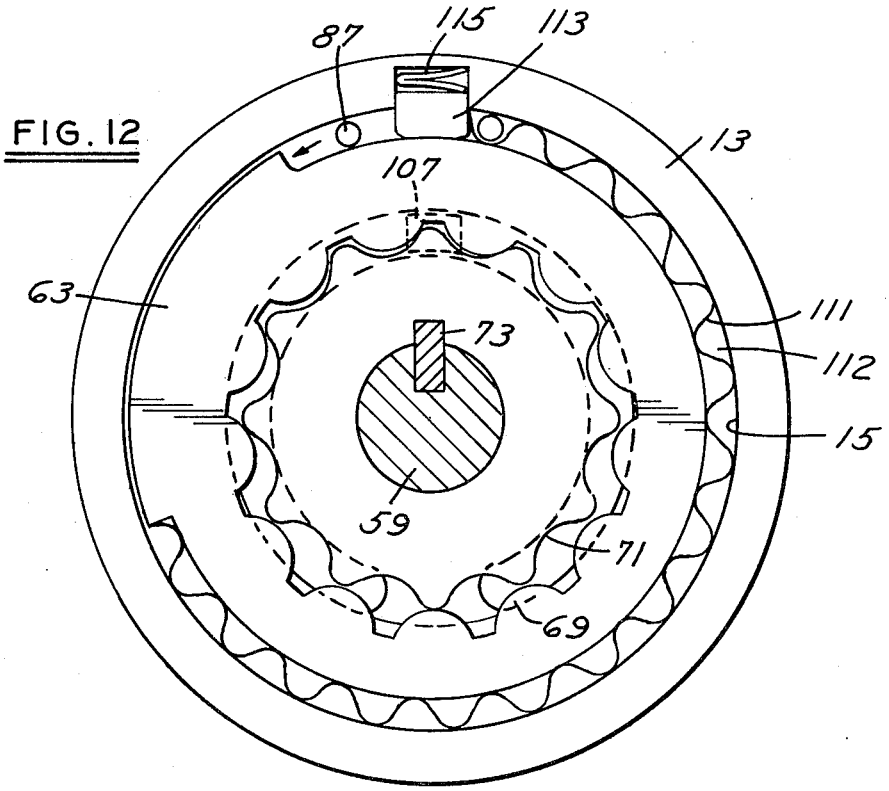

POSITIONABLE CONTROL DEVICE FOR A VARIABLE DELIVERY PUMP

BACKGROUND OF THE INVENTION

Illustrative of variable displacement pumps are the gerotor type or vane type consisting of a controlled element and a control element which are eccentric to each other such as: U.S. Pat. Nos. 2,266,191 Granberg Dec. 16, 1941 (vane type) 2,649,739 Hufferd et al Aug. 25, 1953 (vane type) 2,678,607 Hufferd et al May 18, 1954 (vane type) 2,685,842 Hufferd Aug. 10, 1954 (vane type) 2,688,927 Nuebling Sept. 14, 1954 (gerotor) 3,026,810 Kubiak et al Mar. 27, 1962 (crescent or gerotor) 3,728,048 Ratliff Apr. 17, 1973 (vane type) 4,097,204 Palmer June 27, 1978 (crescent).

Characteristic of each of these variable delivery pumps whether vane operated or employing a gerotor with inner and outer gerotors, there is defined between the respective drive and driven elements controlled thereby an eccentric relationship which can in one manner or another be modified in some instances as to provide for the variable delivery of pressurized fluids from a pump. Generally speaking, it appears in each of these illustrations a means may be employed for regulating the eccentric position between the controlled and control elements which may be gears as in a gear pump or vanes in a vane type pump in order to preset the pump for a particular volume of delivery.

SUMMARY OF THE INVENTION

It is a feature of the present invention to provide a novel positional control device to arrange certain pump elements therein in a predetermined angular relationship to their predestined function.

It is a feature to control the angular position of such control device in a pump whose pumping capacity is dependent upon the eccentric position between the pumping elements.

It is another feature to provide the most economical manufacture of components to accomplish the intended task of controlling devices such as in variable delivery pumps.

It is yet another feature to arrange the control elements in such a manner so as not to enlarge greatly the physical envelope of present constant delivery pumps by virtue of a change to a variable delivery.

It is a further feature to provide a rotatable hydraulic reaction member upon the body of the rotatable control device and to provide a stationary reaction member upon the pump housing spaced from the hydraulic reaction member to define a pressure chamber wherein channel means are provided within the housing interconnecting the fluid outlet to the pressure chamber for delivery of fluid pressure thereto tending to rotate the body in one direction, wherein opposing spring means are interposed between the housing and the body yieldably biasing the body for rotation in the opposite direction for creating a balanced force condition depending upon the output volume demand connected to the fluid outlet.

A further feature of the invention provides for a variable delivery hydraulic pressure fluid source external of the housing and which is connected by the channel means to the pressure chamber wherein the opposing spring means creates a balanced force condition depending upon the hydraulic pressure fluid in the external source delivered to the pressure chamber.

These and other features will be seen from the following specification and claims in conjunction with the appended drawings.

THE DRAWINGS

FIG. 1 is a vertical section, partly schematic, of a hydraulic pump including the present positionable control device as mounted upon a support fragmentarily shown for receiving and delivering the hydraulic fluid.

FIG. 2 is a vertical section taken in the direction of arrows 2—2 of FIG. 1, partly rotated.

FIG. 5 is an end elevational view facing the port plate with an annular fluid passage therethrough, the positionable control device protrusion movable within said passage between its upper-most position of maximum delivery to its lower-most position of minimum delivery.

FIG. 6 is a plan view of the port plate with the angular position or positionable control device omitted.

Figure 10:
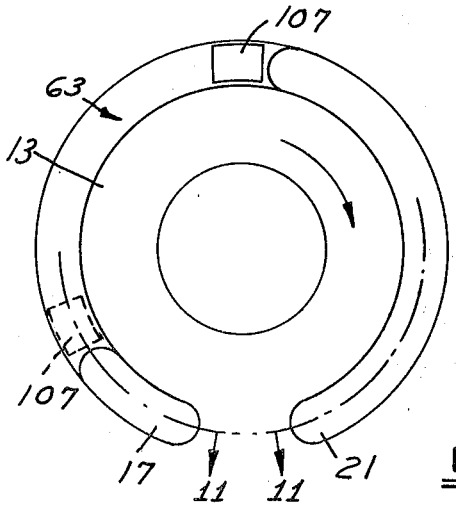
FIG. 10 is an end elevational view similar to FIG. 5 illustrating the position of the positionable control device in solid lines in maximum delivery position and in dash lines in minimum delivery position with repsect to an annular port plate aperture and with respect to registering intake and outlet ports of the housing body.
Figure 11:
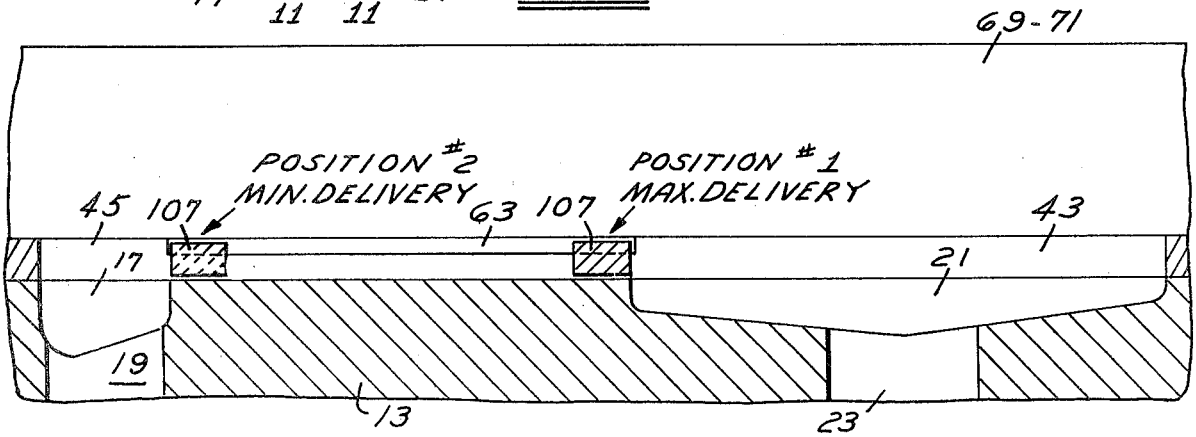

FIG. 11 is a fragmentary view on an enlarged scale taken in the direction of arrows 11—11 of FIG. 10 illustrating the location of the housing intake port with respect to the variable annular fluid passage in the port plate as controlled by the protrusion upon the positionable control device nested within the port plate recess, so as to schematically show its positions of maximum and minimum delivery.

Figure 3:
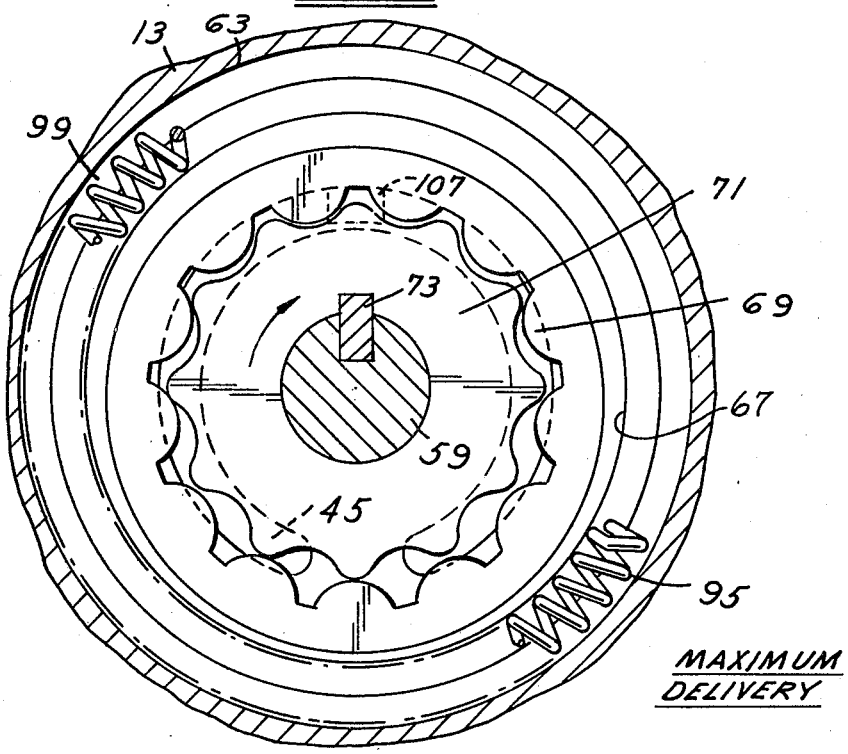
FIG. 3 is a fragmentary view taken in the direction of arrows 3—3 of FIG. 1 illustrating the positionable control device in an angular position for full pumping mode.

FIG. 12 is a modification and corresponds to FIG. 3 illustrating the spring means as a leaf spring and with the stationary reaction member yieldably mounted upon the pump housing relative to the pressure chamber.

FIG. 13, adjacent FIG. 1, is a section in an enlarged scale taken in the direction of arrow 13 of FIG. 1.

Figure 14:
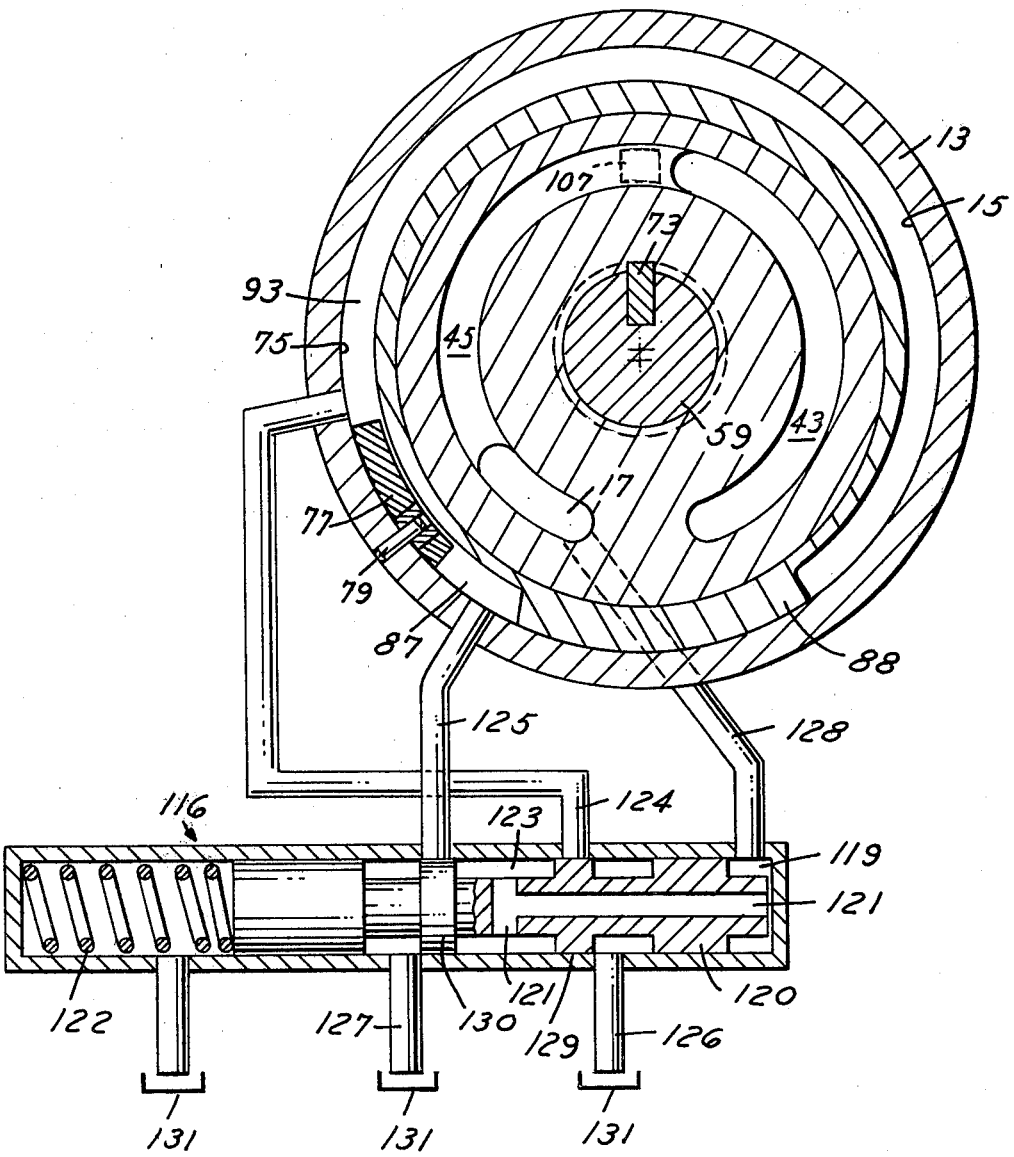

FIG. 14 is another modification and corresponds generally with FIG. 2 illustrating the control of the pump by a hydraulic valve.

It will be understood that the above drawings illustrate merely a preferred embodiment of the invention, and that other embodiments are contemplated within the scope of the claims hereinafter set forth.

DETAILED DESCRIPTION OF AN EMBODIMENT OF THE INVENTION

Referring to the drawings and particularly FIG. 1, an illustrative variable delivery pump or fluid rotary power transmission is generally indicated at 11 which includes a pump housing 13 having a cylindrical bore 15, exhaust port 17 and a communicating exhaust passage 19. The housing 13 includes intake cavity 23 wich has a fluid intake tube 25 connected thereto and sealed therein as at 27, and having a transverse support plate 29 secured to the housing 13 as by fastener 31. The intake tube 25 is adapted for suitable connection to a reservoir R schematically shown within which is the stored hydraulic fluid or any other fluid to be pumped.

Associated with pump 11 and fragmentarily shown in FIG. 1 is an external power actuating device or support 33 to which the pump housing 13 is secured. The power actuating device 13 includes the pressure fluid delivery passage 35 fragmentarily shown adapted for delivering fluid under pressure to any power actuating mechanism which makes uniform or varying demands of pressure fluid volume delivery thereto from the present variable delivery pump 11. The mounting of the pump 11 to the external power actuating device 33 includes the pump flange 37 in registry therewith anchored by fasteners 39.

Nested within housing bore 15 is the stationary port plate 41, FIG. 1, which has a combination arcuate intake passage 43 and arcuate outlet passage 45 in communication therewith, as shown in FIG. 2. The arcuate passage 43–45 is arranged adjacent housing exhaust port 17 and housing intake port 21, respectively.

The chamber forming a part of the pump housing 13 is further defined by end plate 47 whose peripheral flange is connected to an adjacent peripheral flange of the pump housing 13 as by a plurality of fasteners 49 with a suitable annular seal 51 interposed.

End plate 47 has an enlarged axial boss 48 and includes an axial bore 53 in registry with the corresponding axial bore 55 within the pump housing 13 and inwardly of its bore 15.

Axially aligned bearings 57 nested respectively within the bores 53 and 55 of the pump 11, are adapted to rotatably receive and journal the drive shaft 59 which at its outer end has a series of splines 61 by which it is connected to a suitable power drive, not shown, such as an electric motor, or other such prime mover. Seal 62 is interposed between boss 48 and shaft 59, and is internally pressurized by passage 64 which provides pressurized lubricating fluid to shaft 59.

Rotatably nested within bore 15 of the pump housing 13 is an angularly adjustable or positionable control member or device 63 which includes a cylindrical body 64. The body 64 has an outer cylindrical surface 65 in cooperative registry with bore 15 and an internal bore or cavity 67 which is eccentric to the outer surface 65.

Figure 4:
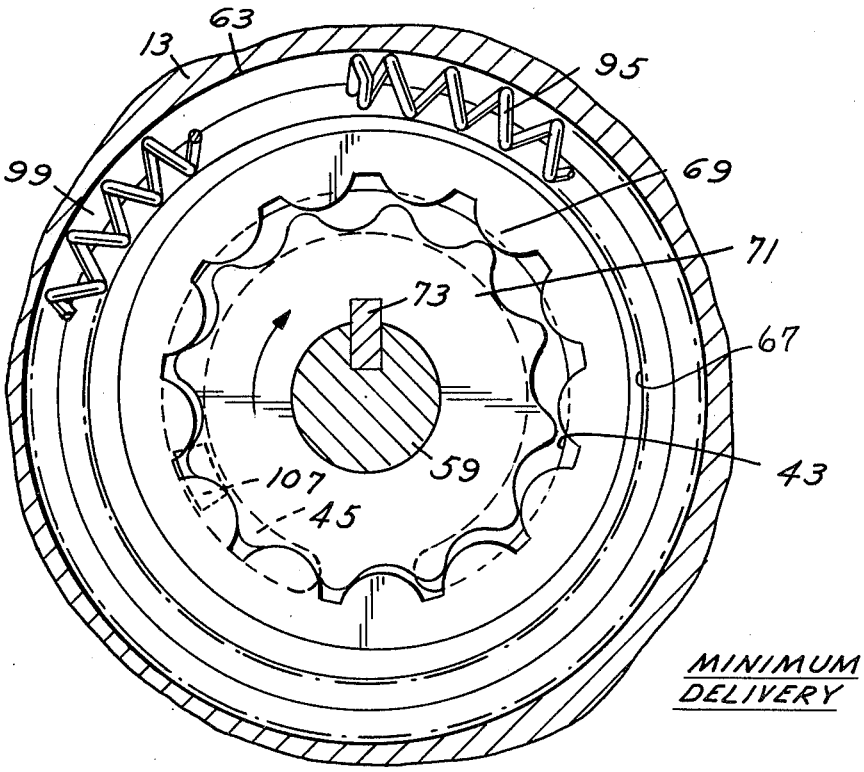
FIG. 4 is a similar view of the pump angular position in a minimum pumping mode.
Figure 7:
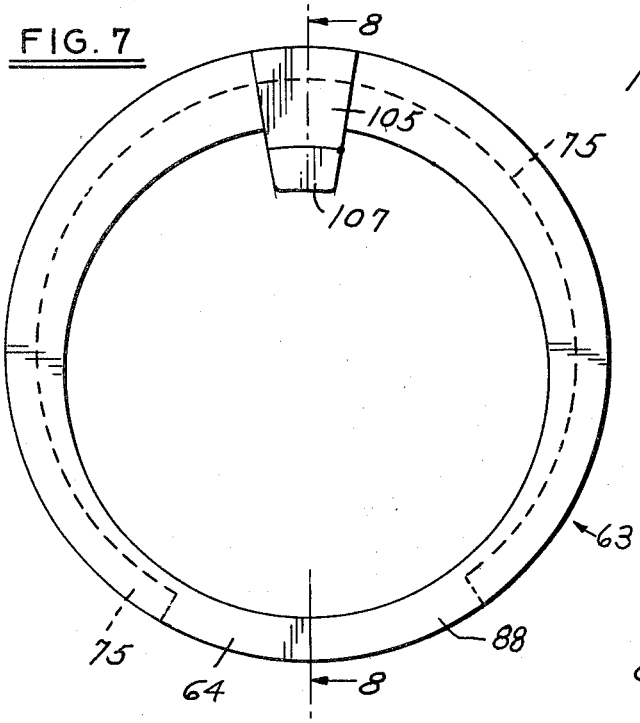
FIG. 7 is a front elevational view of the positionable control device shown in FIG. 8.
Figure 8:
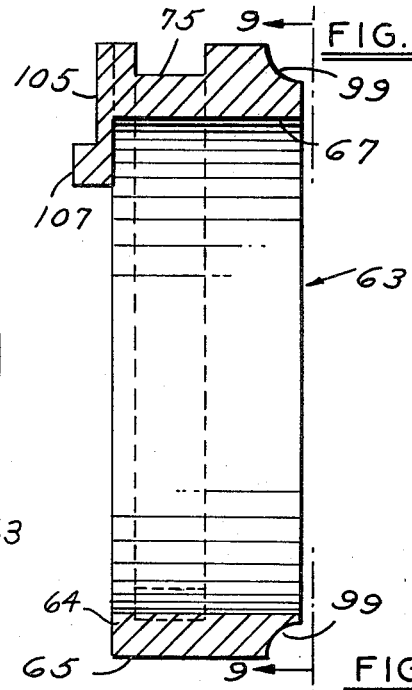
FIG. 8 is a vertical section taken in the direction of arrows 8—8 of FIG. 7.
Figure 9:
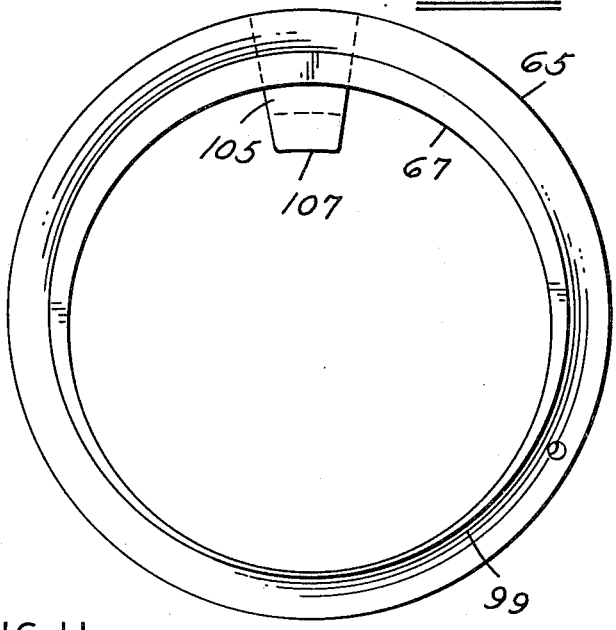
FIG. 9 is an end view thereof taken in the direction of arrows 9—9 of FIG. 8.

In the illustrative embodiment, a gerotor assembly is nested within bore 67 of the positional control member or device 63 which includes an outer gerotor 69 nested within bore 67, and loosely and eccentrically positioned within the outer gerotor 69 is an inner gerotor 71, such as shown in FIGS. 3 and 4. The drive shaft 59 extends through the inner gerotor 71 and is suitably secured thereto in driving relation as by the key or spline 73, FIG. 1.

The gerotor assembly includes the internal or inner gerotor 71 eccentric to and in driving engagement with the internal gear of the outer gerotor 69, and due to the eccentric relationship between the inner and outer gerotors provides on rotative drive of the inner gerotor 71 a pumping action. This is a conventional type of gerotor pump such as shown in U.S. Pat. No. 2,688,927, or manufactured by W. H. Nichols Co., Portland, Maine, Brown and Sharp Inc., Providence, R.I. and others.

The conventional operation of the gerotor of the gear type, such as shown in the patents incorporated herein by reference, only to establish the normal action of the present gerotor 69–71 wherein its pumping action is determined by the eccentric relationship between the outer gerotor 69 and the inner gerotor 71.

The inner gerotor 71 is in driving engagement with the interior teeth, greater in number than the teeth of the outer gerotor 69 of the inner gerotor 71. There is such spaced relation and such eccentricity therebetween, that there is a pumping action by which pressure fluid from the pump cavity 23 and intake port 21 passes through arcuate intake passage 43 into the space between the internal gears of the gerotor on one side thereof and upon continued rotation, pressure fluid is delivered outwardly of the gerotor assembly into the arcuate outlet passage 45 within the port plate 41 which is in substantial registry therewith. The fluids or liquids so pumped are delivered through exhaust port 17, exhaust passage 19 in communication therewith and through pressure fluid delivery passage 35 which is directed to any suitable power actuating device such as fragmentarily shown at 33, FIG. 1.

In accordance with the conventional operation of gerotors, the extent of the eccentricity between the inner and outer gerotors determines the volume of liquid delivered through the exhaust port 17 and out through the exhaust passage 19.

In accordance with the present invention, eccentricity between the control member or inner gerotor 71 and the outer gerotor or controlled member 69 may be modified by rotative adjustment of the positionable control member or device 63.

In accordance with the present invention, the rotative adjustment of the positionable control member or device 63 in one direction or the other, angularly regulates the position of the eccentricity between the inner and outer gerotors 71–69, thereby modifying the volume of liquid fluid delivered by the pump.

The hereinabove described inner gerotor is referred to as the control member 71. The outer gerotor 69 has been referred to as the controlled member.

It is contemplated as equivalent construction, that in place of the inner and outer gerotor there may be employed a vane type of pump that is also shown in a number of the patents referred to in the background of the invention whose mode of operation is incorporated herein by reference, wherein the pumping action of that type of pump is again dependent upon the eccentricity between the center of rotation of the vane supports and the cavity within which the vanes rotate. Therefore, while the present disclosure is directed primarily to the positionable control member or device for a variable delivery pump, such as normally uses a gerotor assembly, the present angularly adjustable control member or device 63 could also be adopted for positioning the eccentricity between parts of a vane type of pump as equivalent thereto.

As has been described, the positionable control member or device 63 is angularly adjustable. The angular adjustment is accomplished automatically and is responsive to pressure within the pump exhaust passage 17 as it is connected to and responds to demand for more or less fluid for operating of a remote power actuating device 33.

Therefore, the present invention is directed to an automatic means by which there will be an automatic angular adjustment of the positionable control member or device 63 within the pump housing 13 depending upon pump volume demand.

More specifically, the present control member body 64 includes an outer annular channel 75 formed therein within which is nested an arcuate hydraulic reaction member 77 secured to the housing 13 as by the force reaction pin 79, FIG. 2.

As shown in FIG. 1, the exhaust port 17 communicates with the radial bleed passage 83 which at its outer end communicates with the axial passage 85 for communicating pressurized liquid or fluid to the interior of the annular channel 75 into the pressure chamber 87, FIG. 2.

Control member body 64 adjacent pressure chamber 87 includes the movable hydraulic reaction member 88 forming a part of the positionable control member or device 63.

Accordingly, pressure fluid from the exhaust passage 19 is directly communicated to pressure chamber 87 as defined between the stationary reaction member 77 mounted on the housing 13 and the rotatable reaction member 88 forming a part of the control member body 64. As shown in FIG. 2, the stationary reaction member 77 extends into the annular passage 75, and along its inner arcuate edge is spaced from a portion of the positionable control member or device 63 as by the bleed passage 81.

As shown in FIG. 1, communicating with intake port 21, there is formed within the pump housing 13 radial passage 89 which at its outer end is in communication with axial passage 91 communicating with the annular channel 75, but upon the opposite side of the stationary reaction member 77 to the secondary chamber 93.

Generally, the pressure chamber 87, due to the pressure created therein, normally biases the rotatable reaction member 88 for movement in a counter direction as shown by the arrows in FIG. 2.

In opposition to the pressure developed within the pressure chamber 87, there is provided an elongated loading coil spring 95, FIGS. 1, 3 and 4, which is nested within an internal annular recess 97 upon the interior of the end plate 47. In the illustrative embodiment, the coil load spring 95 is further nested within an exterior annular recess at 99 formed within the positionable control member or device 63 and an adjacent annular recess 100 in housing 13.

One end of the spring 95 is secured to the end plate 47 as at 101, FIGS. 1 and 13, or may otherwise be secured to the housing 13. The opposite end of the coil sping 95 is anchored as at 103, FIG. 1, to an exterior portion of the control member body 64.

Referring to the positionable control member or device 63 and its body 64, shown in FIGS. 7–11, the bore of the control member body 64 shown at 67 is eccentric to the outer cylindrical surface 65 on the body 64. Upon one end of the body 64, is the radilly inwardly extending land 105 which terminates in the axial outwardly extending protrusion or boss 107. The boss 107 is movably positioned within the port plate annular recess 43–45 such as shown in FIGS. 1, 2, 5, 10 and 11.

The relative position of the protrusion 107 within the port plate recess 43–45 is illustrated in FIG. 3 wherein due to a reduction in fluid pressure within the exhaust passage 19 due to increased demand, coil spring 95 is effective to bias the control member body 64 and protrusion 107 to the position shown in FIG. 3.

As shown in FIG. 11, such position of the protrusion 107 with respect to the port plate annular recess 43–45, with respect to the corresponding intake port 21 and exhaust port 17 provides for the maximum delivery of fluid through the exhaust port 17.

On the other hand, the protrusion 107 may be caused to move in a counter-clockwise direction from the position shown in FIG. 3 to the position shown in FIG. 4 due to an increase in the pressure within the exhaust port 17 due to decreased demand. This is a secondary position for minimum delivery as best shown in FIGS. 10–11 for delivery of pressure fluid from the gerotor through the arcuate outlet 45 in the port plate 41 and into the exhaust passage 19.

In comparing FIGS. 3 and 4, the rotation of the control device protrusion 107 from the position shown in FIG. 3 to the position shown in FIG. 4, the eccentricity between the control member or inner gerotor 71 and the controlled member or outer gerotor 69 has been positionable changed. Internally of the port plate 41 there is formed a radial recess 109, FIG. 1, adapted to cooperatively receive the radial land 105 of the control device body 64, FIG. 8.

The protrusion 107 of the positionable control device 63 is fitted into the port plate passage 43–45 to separate intake and exhaust flow by the width of the land 105 and adjacent protrusion 107.

Radial passage 89 connects intake port 21 with chamber 91, as in FIGS. 1 and 2, for exhausting leakage flow at 81 past the hydraulic reaction member 77 from the pressure chamber 87.

In operation, the exhaust hydraulic pressure within passage 19 acts upon the protrusion 107 of the positionable control device 63 which is movably nested within the channel 43–45 of the port plate 41. This results in a force acting in the direction of rotation of the pump 11, such as clockwise, when viewing the pump from the spline end 61 shown in FIG. 1.

At the same time, hydraulic pressure from the pump exhaust 19 is communicated into the pressure chamber 87 creating a reactive force opposite to that of rotation of shaft 59.

The force acting on the reaction member 77 has a greater value due to is area and distance from the center line of rotation. Thus, the remaining unbalanced force can be counteracted by utilizing the present spring load member 95 which is adapted for rotating the control member body 64 in the opposite direction.

OPERATION

Thus, in the operation of the present variable delivery pump 11, when the output pressure passage 35 and 19 begins to decrease because of increased external demand, force on the movable reaction member 88 decreases in the pressure chamber 87. Consequently, the spring 95 urges the positionable control member or device 63 into increased pumping position, such as shown in FIG. 3.

When the output flow has exceeded the demand, output pressure rises in the passages 35 and 19 increasing the pressure within pressure chamber 87 thus overcoming the spring force 95 and urging the positionable control member or device 63 into less pumping delivery position or mode such as shown in FIG. 4.

MODIFICATION

In the modified construction shown in FIG. 12, coil spring 95, FIGS. 3, 4, is replaced by leaf spring 111 which is nested within a recess 112 formed within the positionable control member or device 63 and relative to housing 13. One end of the leaf spring 111 engages the positionable control member or device 63, while the opposite end of the leaf spring 111 is in engagement with the housing 13 by its contact with the stationary reaction member 113, mounted within housing 13 and biased radially inward with respect to the channel 112 as by the spring means 115.

The operation of the positionable control device 63 is exactly the same as above described with respect to the use of coil springs 95, such as shown in FIGS. 1, 3 and 4. The location of the movable reaction member 88 relative to the protrusion 107, as shown in FIG. 12, is modified to accommodate the leaf spring 111.

In the embodiment, FIG. 12, the leaf spring 111 and the hydraulic actuator or stationary reaction member 113 are upon the same side of the control member device body. The stationary reaction member 113 is loaded by the spring 115.

MODIFICATION

As a modification in the present embodiment, a hydraulic control valve 116 may be predisposed in such a manner so as to infinitely vary the angular position of positionable control element or device 63 and subsequently pump output flow according to external demand. Spring 95 may be retained as a light loading device to position the pump 11 into maximum delivery relationship during start-up of the pump, this being desirable from pump priming consideration.

Referring now to FIG. 14, exhaust pressure from output passage or exhaust port 17 connected by passage 128 to surface area 119 of control spool 120 counterbalances the force imposed by spring 122. Pressure fluid from passage 128 communicates with annulus 123 of spool 120 through passages 121, but is isolated from passages 124 and 125 by lands 129 and 130 of spool 120 from communication with pressure chamber 87 and chamber 93. As hydraulic output pressure in passage or exhaust port 17 increases due to decreased fluid volume, output demand force on area 119 of control spool 120 increases to the extent of overcoming opposing force of spring 122. Axial movement of spool 120 in direction of the spring 122 connects annulus 123 with passage 125 and pressurizing chamber 87. Simultaneously, the same movement connects passage 124 with chamber 93 and passage 126 thereby communicating chamber 93 with oil pump 131. Hydraulic reaction force in pressure chamber 87 acting on member 88 of positionable control element or device 63 overcomes hydraulic reaction force generated by pressure from output passage 17 acting on protrusion 107 in the direction of maximum pump delivery. Since the force acting on member 88 has a greater value due to its area and distance from the center line of rotation, the resultant rotation of positionable control element or device 63 is opposite to pump rotation or decreasing output flow. Conversely, when external demand increases, pressure in exhaust passage or port 17 consequently decreases. Hydraulic force on area 119 of spool 120 also decreases enabling the force of spring 122 to overcome the hydraulic reaction force on spool 120 and forcibly move spool 120 in direction away from spring 122, connecting pressure source from annulus 123 to passage 124 and chamber 93, simultaneously opening channel 125 with channel 127 and oil sump 131, thereby exhausting liquid in chamber 87. The resulting force acting on element 88 forming part of the control element or device 63 is in the direction of pump rotation thusly increasing pump output flow.

It is readily understood that pressure from an external source other than output passage or exhaust port 17 can be utilized to control position of spool 120 and consequently the angular position of the positionable control member element or device 63 regulating the pump output flow as previously described.

Having described my invention, reference should now be had to the following claims.

I claim:

1. In a fluid rotary power transmission having a housing with a cylindrical bore, a fluid intake and a fluid outlet communicating with said bore through a port plate having a fixed crossover land and a movable crossover land separating said fluid intake from said fluid outlet;

a positionable control device comprising a cylindrical body having an outer diameter rotatably and adjustably nested in said bore;

and having an inner diameter eccentric to said outer diameter;

a fluid power mechanism including an outer controlled member rotatably nested within said body and a power driven inner control member rotatably nested within said controlled member and eccentric thereto, and drivably engaging the controlled member to provide a fluid pumping action between said intake and outlet;

the eccentric position between said controlled and control members being variable for selectively increasing and decreasing the volume outlet of fluid;

selective rotation of said positionable control device within said housing and relative to said controlled and control members correspondingly modifying and changing said eccentric position, relative to said fixed crossover land.

2. In the fluid rotary power transmission of claim 1, said body being adapted for infinitely positionable angular relationship relative to said housing bore for correspondingly varying the relative eccentric angular position of said controlled and control members for a corresponding range between minimum and maximum fluid flow.

3. In the fluid rotary power transmission of claim 1, said body having a rotatable fluid reaction member;

a stationary reaction member on said housing spaced from said fluid reaction member defining a pressure chamber; and channel means within said housing interconnecting said fluid outlet and said pressure chamber for delivering pressure fluid thereto, tending to rotate said body in one direction.

4. In the fluid rotary power transmission of claim 3, wherein spring means is interposed between said housing and said body yieldably biasing said body for rotation in the opposite direction to said one direction for creating a balance force condition depending upon an output volume demand connected to said fluid outlet.

5. In the pump of claim 4, said spring means being a leaf spring.

6. In the pump of claim 5;

said body having an annular groove therein at its outer diameter;

said stationary reaction member being nested within said groove;

the movable hydraulic reaction member being movable relative to said stationary reaction member, said stationary reaction member being adjustably secure to said housing;

and a spring in said housing radially biasing said reaction member into said body annular groove.

7. In a pump having a housing with a cylindrical bore, a fluid intake and a fluid outlet communicating with said bore;

a positionable control device comprising a cylindrical body having an outer diameter rotatably and adjustably nested in said bore;

and having an inner diameter eccentric to said outer diameter;

a pump mechanism including an outer controlled member rotatably nested within said body and a power driven inner control member rotatably nested within said controlled member and eccentric thereto, and drivably engaging the controlled member to provide a fluid pumping action between said intake and outlet;

a port plate having an annular groove therethrough adjacent to the intake and outlet, a first passage open to said intake and being defined in the annular groove between an arcuately movable boss and a stationary boss, and a second passage open to said outlet and being defined in the annular groove between the arcuately movable boss and the stationary boss to maintain the first passage separate from the second passage;

the eccentric position between said controlled and control members being variable for selectively increasing and decreasing the volume outlet of fluids;

selective rotation of said control device within said housing and relative to said controlled and control members correspondingly modifying said eccentric position, and arcuately shifting the movable boss between the first and second passage to change the relative size of each.

8. In the pump of claim 7, said body being adapted for infinitely positionable angular relationship relative to said housing bore for correspondingly varying the relative eccentric angular position of said controlled and control members for a corresponding range between minimum and maximum fluid flow.

9. In the pump of claim 7, said outer controlled member being an outer gerotor;

said inner control member being an inner gerotor.

10. In the pump of claim 7, the port plate being stationary and nested within said housing said annular groove being formed therethrough adjacent and in registry with said pump intake and outlet;

said control and controlled members defining a pump chamber;

said annular groove being in registry with said pump chamber.

11. In the pump of claim 7, said movable boss comprising an axial protrusion radially inward of the inner diameter of said body at one end, movably nested within said port plate groove, separating intake and exhaust flow of fluids;

said protrusion defining a fluid inlet and outlet of variable arcuate length within said annular groove depending upon rotary adjustment of said body whereby enlargement of one of the later fluid inlet and outlet effects a proportional respective reduction of the other of said inlet and outlet.

12. In the pump of claim 11, the exhaust fluid pressure defining a force acting on said protrusion in the direction of pump rotation.

13. In the pump of claim 12, said exhaust fluid pressure connected to said pressure chamber creating a reactive force opposed to said direction of rotation, said fluids being balanced by opposing spring means interposed between said housing and said body for rotation in the direction opposite to the direction of rotation for creating a balanced force condition dependent upon the output volume demand at the fluid outlet.

14. A variable displacement power transmission comprising:

a housing having a cylindrical bore with an inlet port and an outlet port opening into the cylindrical bore, said bore having a first axis centrally located therein;

a port plate having a stationary portion and an arcuately shiftable portion disposed in the cylindrical bore adjacent the inlet and outlet ports;

a positionable control device having an outer cylindrical surface concentric with said first axis for nesting in said bore and being arcuately shiftable therein, said positionable control device having an inner cylindrical surface having a second axis centrally located therein, said second axis being parallel to and spaced from said first axis;

said positionable control device being secured to the arcuately shiftable portion of the port plate;

an arcuate intake passage in communication with the inlet port and an arcuate outlet passage in communication with the outlet port, said passages being formed in the port plate in spaced relation to one another at a first radial location;

a land forming part of the arcuately shiftable portion of the port plate to separate the arcuate intake passage and arcuate outlet passage at a second radial location, said land being intersected by a plane extending through the first and second axes;

a mechanism for transferring a fluid from the intake passage to the outlet passage comprising an inner gerotor mounted on a drive shaft for rotation about said first axis and an outer gerotor having a cylindrical outer surface nested within the inner cylindrical surface of said positionable control device for rotation about said second axis, said inner and outer gerotors being eccentric to one another and being in driving engagement at one location intersected by said plane extending through said first and second axes;

whereby the quantity of fluid transferred per revolution of said shaft from the intake passage to the outlet passage at one of said radial locations is varied by arcuately shifting the positionable control device about the first axis and return of fluid from the outlet passage to the inlet passage at the other of said radial locations is blocked.

15. The variable displacement power transmission of claim 14 wherein said land is moveable relative to the first radial location where the passages are spaced relative to one another.

16. The variable displacement power transmission of claim 14 wherein said land is attached to the positionable control device and extends radially inwardly therefrom to be moved within the arcuate intake and outlet passages as the positionable control device is shifted.

* * * * *